US009260961B2

(12) United States Patent
Miller et al.

(10) Patent No.: US 9,260,961 B2
(45) Date of Patent: Feb. 16, 2016

(54) MODULAR MONITORING ASSEMBLY

(71) Applicants: James L. Miller, Willis, TX (US); Jason C. Mailand, The Woodlands, TX (US)

(72) Inventors: James L. Miller, Willis, TX (US); Jason C. Mailand, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 294 days.

(21) Appl. No.: 13/918,007

(22) Filed: Jun. 14, 2013

(65) Prior Publication Data

US 2014/0367168 A1 Dec. 18, 2014

(51) Int. Cl.
*E21B 47/12* (2012.01)
*E21B 47/01* (2012.01)

(52) U.S. Cl.
CPC ..... *E21B 47/12* (2013.01); *E21B 47/01* (2013.01); *E21B 47/124* (2013.01)

(58) Field of Classification Search
CPC ..... E21B 23/004; E21B 23/006; E21B 23/02; E21B 47/01; E21B 47/011; E21B 47/124; E21B 44/00
USPC ..... 73/152.01–152.62; 340/853.1–856.4
See application file for complete search history.

(56) References Cited

U.S. PATENT DOCUMENTS

| | | | | |
|---|---|---|---|---|
| 4,510,551 | A | 4/1985 | Brainard, II | |
| 5,303,773 | A | 4/1994 | Czernichow et al. | |
| 5,563,512 | A * | 10/1996 | Mumby | 324/339 |
| 6,046,685 | A * | 4/2000 | Tubel | 340/853.2 |
| 6,224,997 | B1 | 5/2001 | Papadopoulos | |
| 6,485,991 | B1 | 11/2002 | Jitramas et al. | |
| 6,705,406 | B2 | 3/2004 | Das et al. | |
| 6,755,257 | B2 | 6/2004 | Spencer et al. | |
| 7,537,061 | B2 | 5/2009 | Hall et al. | |
| 7,980,331 | B2 | 7/2011 | Hall et al. | |
| 2004/0251048 | A1 | 12/2004 | Kurkoski | |
| 2005/0024231 | A1 * | 2/2005 | Fincher et al. | 340/854.4 |
| 2005/0145416 | A1 | 7/2005 | Reed et al. | |
| 2006/0102347 | A1 | 5/2006 | Smith | |
| 2006/0196664 | A1 | 9/2006 | Hall et al. | |

(Continued)

FOREIGN PATENT DOCUMENTS

| | | | |
|---|---|---|---|
| JP | 3174003 | U | 3/2012 |
| WO | 2009088501 | A1 | 7/2009 |

OTHER PUBLICATIONS

Odplegacy.org; [online]; [retrieved on Sep. 4, 2013]; retrieved from the internet http://odplegacy.org/PDF/Operations/Science/Lab_Procedures/Cookbooks/Downhole/CB-RMM_Manual.pdf. "Core Barrel Retrievable Memory Module (CB-RMM)", Feb. 2004, 20p.

(Continued)

*Primary Examiner* — Giovanna C Wright
*Assistant Examiner* — Tara Schimpf
(74) *Attorney, Agent, or Firm* — Cantor Colburn LLP

(57) ABSTRACT

A monitoring assembly, including a sleeve, a sensor for monitoring one or more selected parameters, and a plurality of modules in communication with the sensor and removably disposed with the sleeve. The plurality of modules includes a first module in an active state and a second module in an inactive state. A detector is included that determines when the first module has been removed from the assembly. The second module transitions to the active state when the first module is removed from the assembly. A method of using a monitoring assembly is also included.

20 Claims, 4 Drawing Sheets

(56) References Cited

U.S. PATENT DOCUMENTS

| | | | | |
|---|---|---|---|---|
| 2006/0283632 | A1 | 12/2006 | Hall et al. | |
| 2010/0132434 | A1 | 6/2010 | Moake | |
| 2011/0191028 | A1 | 8/2011 | Ross et al. | |
| 2012/0080184 | A1 | 4/2012 | Jahangir et al. | |
| 2013/0120154 | A1 * | 5/2013 | Gleitman | 340/854.4 |

OTHER PUBLICATIONS

IODP USIO; [online]; [retrieved on Sep. 4, 2013]; retreived from the Internet http://iodp.ldeo.columbia.edu/TOOLS_LABS/SPECIAL/cb_rmm.html. "Downhole logging tools Specialty Wireline Tools Core Barrel—Retrievable Memory Module (CB-RMM)"; 2003-2013; 2p.

Falcon Oilfield Services, [online]; [retrieved on Sep. 4, 2013]; retrieved from the Internet http://falconofs.com/services/reservoir/downhole/. "Permanent and Retrievable Downhole Gauges", 2013, 1p.

PTS-Technology; [online]; [retrieved on Sep. 4, 2013]; retrieved from the Internet http://www.pts-technology.com/pdf/dst/dst-memory-gauges.pdf. "Downhole Surface Tools. Downhole Tools—Memory Gauges", 1p.

Notification of Transmittal of the International Search Report and the Written Opinion of the International Searching Authority, or the Declaration; PCT/US2014/037699; Sep. 15, 2014, 10 pages.

* cited by examiner

MODULAR MONITORING ASSEMBLY

BACKGROUND

Systems for monitoring borehole operations have become increasingly pervasive in the downhole drilling and completions industry. Parameters such as temperature, pressure, acoustics, or others can provide insight into various borehole activities in order to enable operators at surface to identify and respond to potential issues, perform an operation more effectively or efficiently, etc. While current systems work sufficiently in many scenarios, the industry always well receives new and alternate monitoring systems.

SUMMARY

A monitoring assembly, including a sleeve; a sensor for monitoring one or more selected parameters; a plurality of modules in communication with the sensor and removably disposed with the sleeve, the plurality of modules including a first module in an active state and a second module in an inactive state; and a detector that determines when the first module has been removed from the assembly, the second module transitioning to the active state when the first module is removed from the assembly.

A method of using a monitoring assembly, including monitoring one or more parameters with a sensor of the monitoring assembly, the monitoring assembly including a plurality of modules, the plurality of modules including a first module in an active state and a second module in an inactive state; communicating between the sensor and the first module of the plurality of modules; detecting when the first module is removed from the monitoring assembly; and transitioning the second module from the inactive state to the active state.

BRIEF DESCRIPTION OF THE DRAWINGS

The following descriptions should not be considered limiting in any way. With reference to the drawings, like elements are numbered alike.

DETAILED DESCRIPTION

A detailed description of one or more embodiments of the disclosed apparatus and method are presented herein by way of exemplification and not limitation with reference to the Figures.

Figure 1:
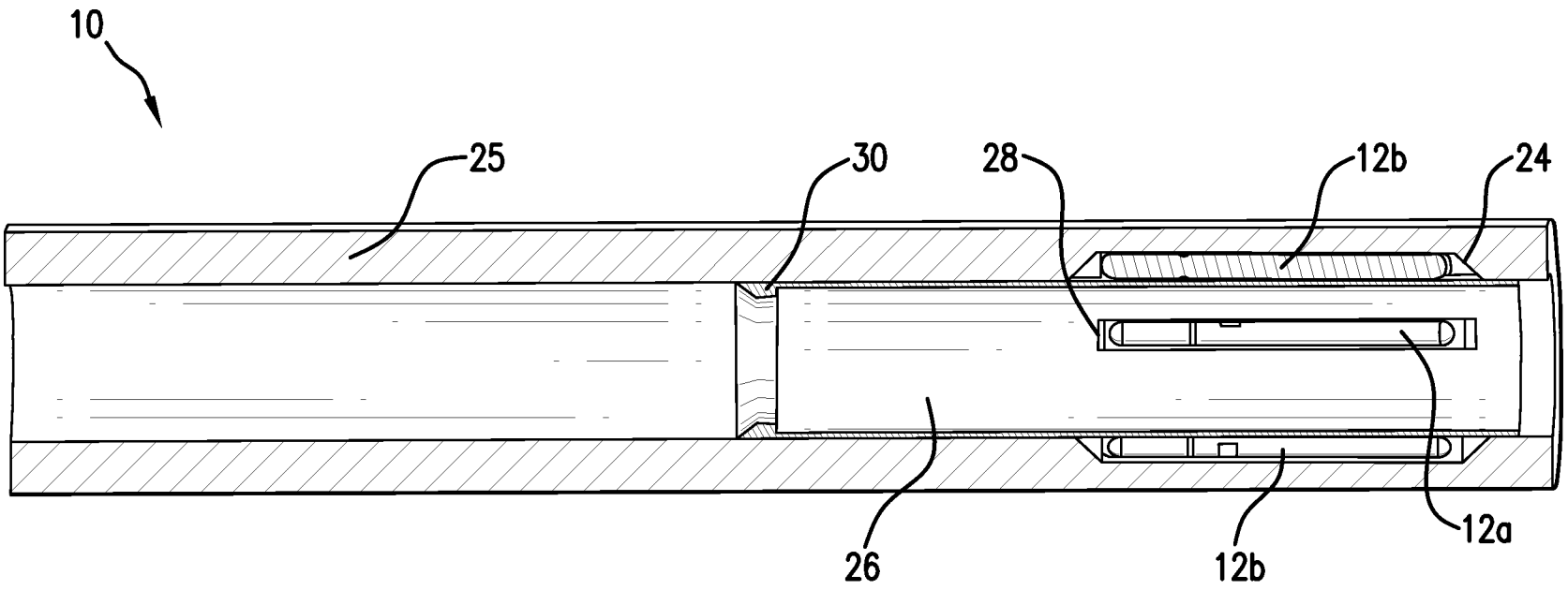
FIG. 1 is a cross-sectional view of a monitoring assembly according to one embodiment disclosed herein.
Figure 2:
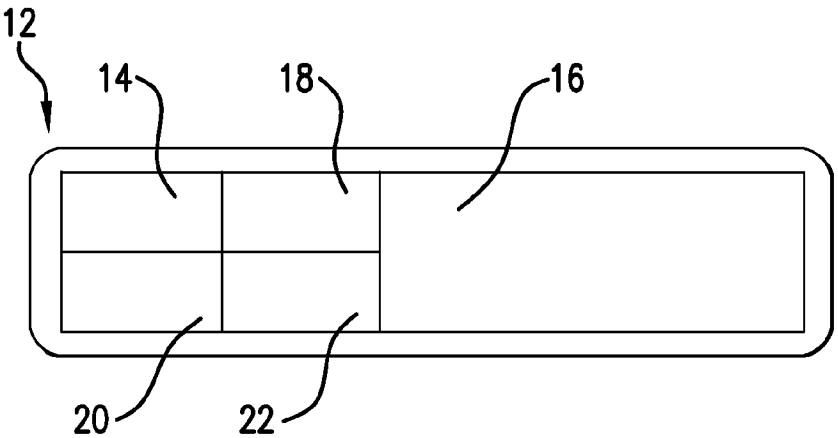
FIG. 2 schematically illustrates a module for the assembly of FIG. 1.

FIG. 1 illustrates a monitoring assembly 10 including a plurality of modules 12. While some individual ones of the modules 12 are given alphabetic identifiers, e.g., 'a' and 'b' for the modules 12*a* and 12*b* (discussed in more detail below), it is to be understood that "the modules 12" refers to all of the modules, including those with the alphabetic identifiers. The assembly 10 can include any combination of sensors, gauges, or other devices for sensing, measuring, or monitoring one or more parameters such as temperature, pressure, etc. (collectively, "sensor" or "sensing device"). These sensing devices can also be included on the modules 12, for example, a sensor 14 is shown schematically in FIG. 2 as being included by one of the modules 12.

A purpose of the modules 12, regardless of whether the sensing device is included by individually by the modules or collectively by the assembly 10, is to communicate with the sensor or sensing device in order to assist in or facilitate the aforementioned monitoring. The communication can be the communication of power, e.g., via one or more batteries or power sources 16. In one embodiment, the communication between the sensor 14 (where included individually on the modules 12 or generally with the assembly 10) and the modules 12 is data communication, and the modules 12 accordingly include a transmitter, receiver, transceiver, or other communication device 18 (e.g., to enable wired or wireless communication between the sensor, components of the module 12, different ones of the modules 12, etc.), a memory or storage media 20 for electronically storing measurements or other monitored information (e.g., in communication with the sensor 14 via the communication device 18 or in an other wired or wireless manner), or other components. Each of the modules 12 may also include a detector 22 for determining when each of the modules 12 is to transition between an inactive status or mode and an active status or mode, as discussed in more detail below.

Figure 3:
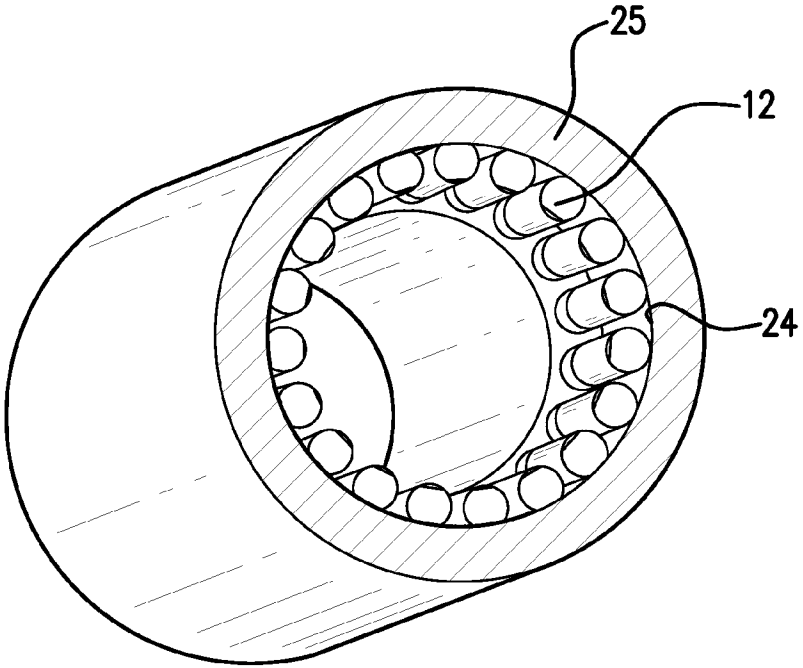
FIG. 3 is a cross-sectional end view of the assembly of FIG. 1.

In the illustrated embodiment, the modules 12 are located in a cavity 24 formed in a sleeve or other tubular member 25. The modules 12 are retained within the cavity 24 via an insert 26. FIG. 3 shows a plurality of the modules 12 located circumferentially within the cavity 24 of the sleeve 25 (with the insert 26 removed for clarity). For reasons discussed in more detail below, it may be desirable to equally space the modules 12 from each other, as shown in FIG. 3. It is also to be appreciated that any number of the modules 12 can be included within the cavity 24, with the cavity 24 shaped and/or sized to accommodate the desired number, size, shape, and orientation of the modules 12.

Figure 4:
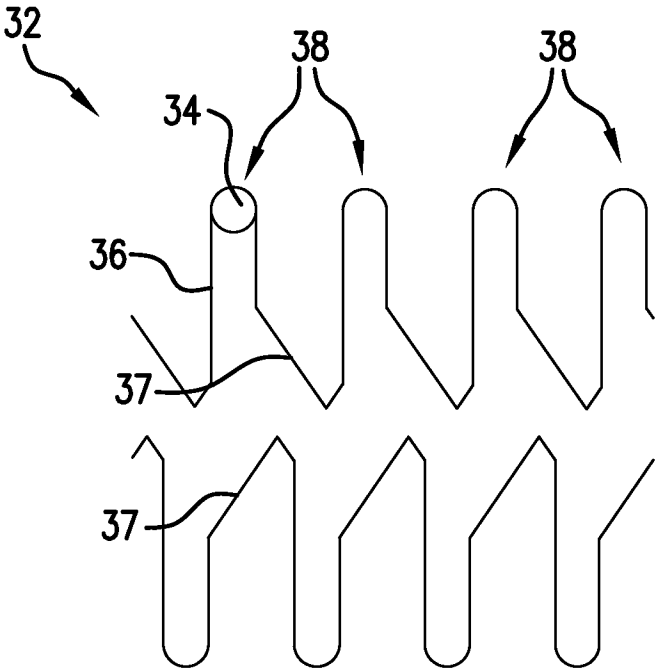
FIG. 4 illustrates an indexing mechanism for controlling movement of an insert of the assembly of FIG. 1.

The insert 26 includes a slot or opening 28 and is movable with respect to the sleeve 25 in order to enable access to selected ones of the modules 12 via the opening 28. For example, in the illustrated embodiment, the insert 26 is arranged such that axial movement of the insert 26 also results in rotation of the insert 26. For example, in the illustrated embodiment, the insert 26 includes an engagement profile 30 that enables a corresponding shifting tool (one example embodiment is discussed below with respect to FIGS. 6 and 7) to selectively grab or grip the insert 26 and move the insert 26 axially. FIG. 4 illustrates an indexing mechanism 32 that can be disposed between the insert 26 and the sleeve 25 in order to cause rotation of the insert 26 when the insert 26 is moved axially, e.g., via the profile 30.

In addition to rotating the insert 26 when moved axially, the rotational movement caused by the indexing mechanism 32 is incrementally set in order to sequentially align the opening 28 properly with each of the modules 12 as a result of cycle of axial movement of the insert 26. Specifically, the indexing mechanism 32 includes a pin 34, e.g., extending radially between the sleeve 25 and the insert 26, that traverses a so-called J-slot pattern 36. The pattern 36 is illustrated "flattened" although it is to be understood that the pattern 36 would be formed circumferentially within or about the insert 26, the sleeve 25, or another insert or component coupled therewith or therebetween. The pin 34 can be coupled or attached to the sleeve 25 and/or the insert 26.

Back and forth axial movement of the pin 34 within the pattern 36 will cause the pin 34 to encounter tapered shoulders 37, resulting in rotation of the insert 26. As noted above, the axial movement of the insert 26 can be caused with a corresponding shifting tool that engages with the insert 26, e.g., at the profile 30. This repeated axial movement of the insert 26 will cycle the pin 34 between a plurality of positions 38. The positions 38 can be rotationally spaced from each other in an amount that corresponds to the spacing between adjacent ones of the modules 12. For this reason, as noted above, it may be desirous to equally space the modules 12 from each other, i.e., to ensure proper alignment of the opening 28 sequentially with the modules 12 via the mechanism 32. Those of ordinary skill in the art will recognize other indexing and/or counting mechanisms that can be used in lieu of the mechanism 32 in order to accurately align the opening 28 of the insert 26 sequentially with each of the modules 12.

Figure 5:
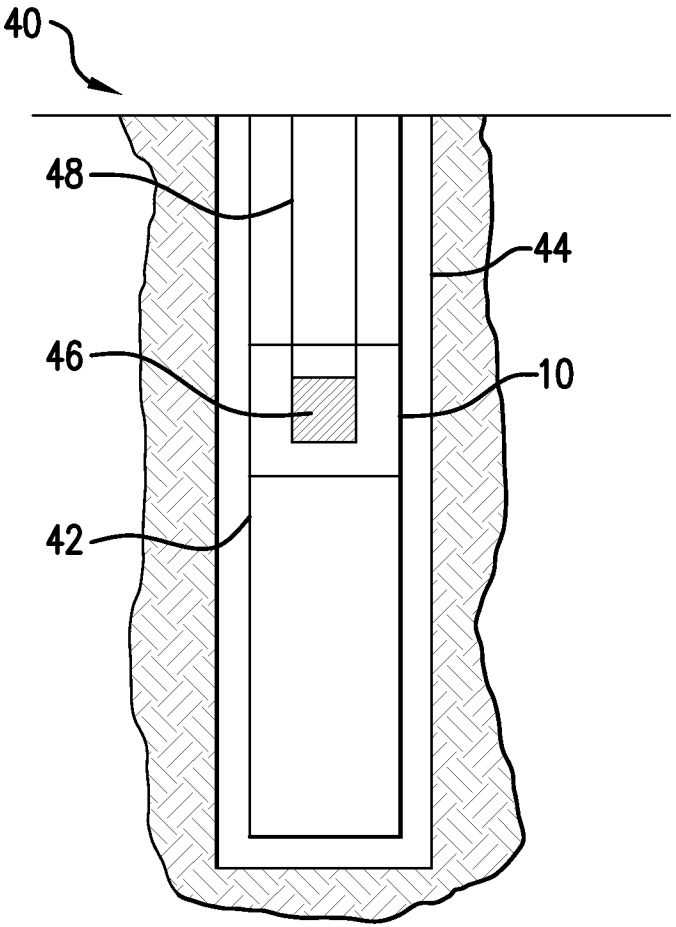
FIG. 5 schematically illustrates a completion system that can include the assembly of FIG. 1.

As depicted schematically in FIG. 5, the sleeve 25 is included by a completion system 40 and connected, e.g., as a joint, along the length of a casing string 42 installed within a borehole 44. For example, the sleeve 25 can include typical box and pin ends for making up threaded connections between the sleeve 25 and the other tubulars forming the casing string 42. Of course, the sleeve 25 can be installed with or along the length of another string and/or via a manner of connection other than threaded. As will be appreciated by those of ordinary skill in the art, the presence of the assembly 10 along the casing string 42 enables the casing string 42 to be a "smart" casing string, providing advantages over current completion systems. A retrieval tool 46 on a work string 48 may be included enable retrieval of the modules 12. A more detailed example of one embodiment for the tool 46 is discussed below with respect to FIGS. 6 and 7.

In general, the modules 12 are arranged such that a selected one (or ones) of the modules 12 are in an active mode or status, while the others of the modules 12 are in an inactive mode or status. By active mode or status, it is meant that the corresponding module is fully operational, or actively monitoring, sensing, measuring, recording, communicating, and/or performing other functions or operations in furtherance of monitoring the system 40, the casing string 42, the borehole 44, etc., or conditions or parameters related thereto. By inactive it is meant that the corresponding modules are turned off, hibernated, put in a standby or power saving mode, or otherwise deactivated or restricted to at most a limited subset of functions. For example, according to one embodiment, the inactive modules are searching or waiting for a preprogrammed trigger or signal to transition the inactive modules to the active status, thereby using a negligible amount of power prior to activation. In this way, at any given time only one (or selected ones) of the modules 12 can be set to the active mode in order to perform desired monitoring, while the others of the modules 12 can assume the inactive status and advantageously conserve battery power.

For example, referring back to FIG. 1, the module 12*a* aligned with the opening 28 can be understood according to one embodiment to be in the active mode, while the modules 12*b* are in the inactive mode. In this way, after the active module 12*a* reaches or approaches the end of its usable life, e.g., the memory 20 is reaching capacity (i.e., filled with data measured or captured by the sensor 14), the battery 16 is nearly depleted, etc., the module 12*a* can be retrieved and one of the inactive modules 12*b* signaled to transition to the active mode and take over monitoring of the desired parameters or conditions. In order to retrieve the active module 12*a*, the insert 26 can be actuated to align the opening 28 with the module 12*a*, enabling the module 12*a* to exit the cavity 24 via the opening 28.

As briefly noted above, the detector 22 can be used to determine when one of the inactive modules, e.g., one of the modules 12*b*, is to be activated. For example, this determination in one embodiment is the result of the detector 22 detecting that the active module 12*a* has been removed or disconnected from the assembly 10, e.g., exiting the cavity 24 via the opening 28 in the insert 26. This results in a signal being sent to one (or more) of the inactive modules 12*b* to activate that module. The modules 12 can be arranged in a sequential order such that as each of the active modules is removed or disconnected from the assembly 10, this removal or disconnection is detected by the detector 22 and a signal communicated to activate a next subsequent one of the modules in the sequential order. Once this newly activated module becomes exhausted or is otherwise removed or disconnected from the assembly 10, the detector 22 will detect this event and signal the next subsequent module 12 to activate. This process can be repeated until all of the modules 12 are retrieved from the assembly 10. It is additionally noted that multiple instances of the assembly 10 could be included, e.g., stacked together or positioned along the length of the casing string 42 or other string. In this way, a secondary one of the assemblies can become activated when a last module of a primary assembly is retrieved.

Figure 6:
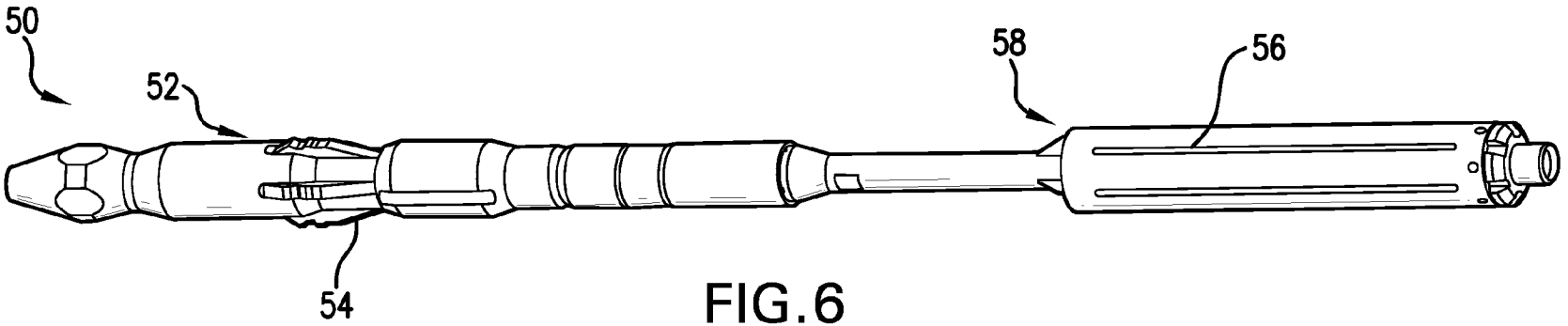
FIG. 6 is a perspective view of a tool arranged to enable retrieval of the modules from the assembly of FIG. 1.
Figure 7:
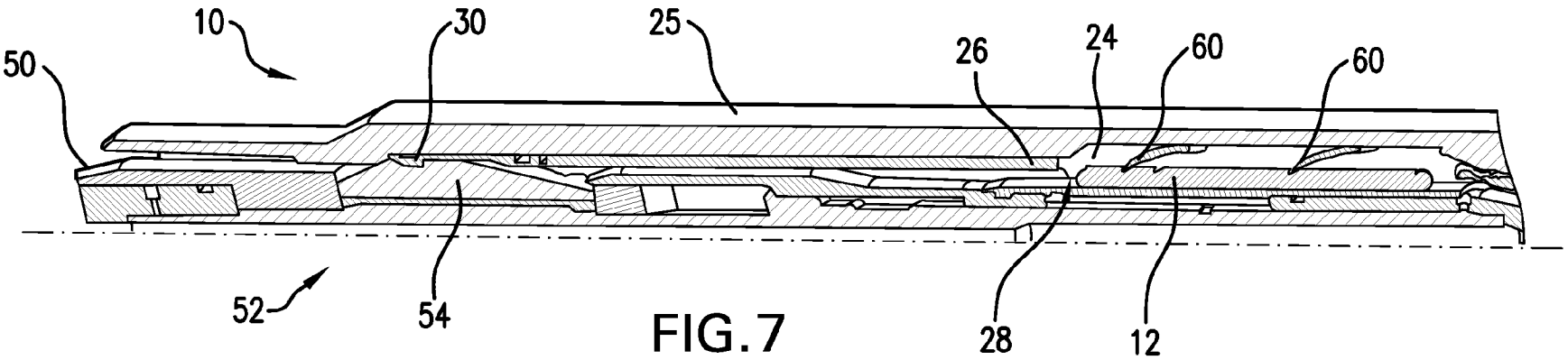
FIG. 7 is a quarter-sectional view of the tool of FIG. 6 engaged within the assembly of FIG. 1 for retrieving a module from the assembly.

A tool 50 is illustrated in FIGS. 6 and 7 for enabling retrieval of selected ones of the modules 12, e.g., the active module 12*a* of FIG. 1. The tool 50 represents one particular example for the tool 46 schematically shown in FIG. 5. The tool 50 includes a shifting mechanism 52 having one or more dogs 54. The dogs 54 are selectively radially outwardly actuatable, e.g., by pressurizing fluid within the tool 50. This enables the dogs 54 to selectively engage, grab, or grip the insert 26, e.g., via the engagement profile 30. Once the tool 50 is engaged with the insert 26, movement of the tool 50, e.g., via a work string extending to surface, can be communicated mechanically to the insert 26. It is to be understood that other selective and/or releasable components can be used in lieu of the dogs 54, such as a collet, magnetic coupling, resilient split or c-ring, etc. It is also to be understood that the insert 26 could be pressure actuated, e.g., via a plug or ball landing at a seat or restriction formed with the insert 26, a pressure differential across the insert 26, etc.

The tool 50 also includes a basket 56 for receiving the module in an open end 58 when the module is released from the cavity 24 via the opening 28 in the insert 26. Ejection of the modules 12 from the cavity 24 can be assisted if desired. For example, as shown in FIG. 7, one or more spring elements 60 can be included in the cavity 24 to resiliently urge the modules 12 toward the insert 26, such that when the opening 28 becomes aligned with a module, the spring elements 60 automatically eject the module out of the cavity 24, where the module can be received by the basket 56. The basket 54 can carry the modules to surface as the tool 50 is pulled out. Once at surface, the memory 20 of the module can be accessed, e.g., data stored in the memory 20 read, retrieved, or downloaded, in order for operators to evaluate the measured parameters, take corrective action to any potential problems indicated by the data, etc. The battery or batteries 16 can be recharged or replaced, the data in the memory 20 erased, and the retrieved modules reused if desired.

The detector 22 can take a variety of forms, several of which are described below. For example, in one embodiment the detector 22 includes a contact, sensor, or switch that is triggered when the corresponding module is removed. For example, the detector 22 can include a component that completes an electric circuit as long as the corresponding one of the modules 12 remains in the cavity 24. The detector 22 can detect the removal of an active module when the circuit is severed or broken due to the module 12 being retrieved from the cavity 24. The contact, sensor, switch, or other component can be electric, mechanical, magnetic, etc. In one embodiment, the detector 22 detects the spring elements 60 being relatively extended, indicating absence of the corresponding module. In one embodiment, the detector 22 includes one or more RFID tags, e.g., with a corresponding reader in the assembly 10 detecting when the modules 12 are moved out of communication with the reader. Those of ordinary skill in the art will readily appreciate other devices that can be used to detect the presence and/or absence of ones of the modules 22 to enable the assembly 10 to transition one (or more) of the inactive modules into the active status when the previously active module is retrieved.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A monitoring assembly, comprising:

a sleeve;

a sensor for monitoring one or more selected parameters;

a plurality of modules in communication with the sensor and removably disposed within the sleeve such that individual modules of the plurality of modules are physically removable from the sleeve and withdrawable to a remote location, the plurality of modules including a first module in an active state and a second module in an inactive state; and a detector that determines when the first module has been physically removed from the assembly, the second module transitioning to the active state when the first module is physically removed from the assembly.

2. The assembly of claim 1, wherein multiple ones of the plurality of modules are in the inactive state.

3. The assembly of claim 2, wherein the plurality of modules is arranged in a sequential order with a next subsequent one of the modules in the sequential order being signaled to transition from the inactive state to the active state when the detector detects that each preceding one of the modules, in the active state, is removed from the assembly.

4. The assembly of claim 1, wherein the sleeve is a part of a casing string.

5. The assembly of claim 1, further comprising an insert to retain the plurality of modules within the sleeve.

6. The assembly of claim 5, wherein the insert includes an opening alignable with selected ones of the modules for enabling the selected ones of the modules to be removed from the assembly.

7. The assembly of claim 6, further comprising an indexing mechanism that limits each movement of the insert to a set incremental amount.

8. The assembly of claim 7, wherein the indexing mechanism translates axial movement of the insert into rotation of the insert.

9. The assembly of claim 7, wherein each set incremental amount of movement aligns the opening in the insert with a next subsequent one of the modules.

10. The assembly of claim 1, wherein the modules each include a battery, a memory, or a combination including at least one of the foregoing.

11. The assembly of claim 1, including a plurality of the detectors with one of the detectors in operable communication with each of the modules.

12. The assembly of claim 1, including a plurality of the sensors, with one of the sensors in operable communication with each of the modules.

13. A system including an assembly according to claim 1.

14. The system of claim 13, further comprising a tool selectively engagable with the assembly to enable removal of selected ones of the modules from the assembly.

15. The system of claim 14, wherein the tool includes one or more dogs that are releasably engagable with a corresponding profile of an insert retaining the plurality of modules within the sleeve.

16. The system of claim 14, wherein the tool includes a basket that receives the selected ones of the modules when they are removed from the assembly.

17. A method of using a monitoring assembly, comprising:

monitoring one or more parameters with a sensor of the monitoring assembly, the monitoring assembly including a plurality of modules, the plurality of modules including a first module in an active state and a second module in an inactive state;

communicating between the sensor and the first module of the plurality of modules;

detecting when the first module is physically removed from the monitoring assembly; and transitioning the second module from the inactive state to the active state when, or after, the first module has been physically removed from the monitoring assembly.

18. The method of claim 17, wherein the one or more parameters relate to downhole conditions of a casing string, a borehole, a completion system, or a combination including at least one of the foregoing.

19. The method of claim 18, further comprising retrieving the first module with a retrieval tool.

20. The method of claim 19, wherein retrieving the first module includes shifting an insert of the monitoring assembly with the retrieval tool in order to permit the first module to exit the monitoring assembly and receiving the first module in a basket of the retrieval tool.

* * * * *